United States Patent [19]

Watanabe

[11] Patent Number: 4,534,666

[45] Date of Patent: Aug. 13, 1985

[54] TRANSFER MATERIAL FEEDING DEVICE

[75] Inventor: Junji Watanabe, Yokohama, Japan

[73] Assignee: Kabushiki Kaisha Toshiba, Kawasaki, Japan

[21] Appl. No.: 619,214

[22] Filed: Jun. 11, 1984

[30] Foreign Application Priority Data

Jun. 13, 1983 [JP] Japan ..... 58-105309

[51] Int. Cl.[3] ..... B41J 35/00

[52] U.S. Cl. ..... 400/207; 400/120

[58] Field of Search ..... 400/207, 208, 208.1, 400/196, 196.1, 120

[56] References Cited

U.S. PATENT DOCUMENTS

| | | | |
|---|---|---|---|
| 4,343,837 | 8/1982 | DeLorenzo | 400/208 X |
| 4,423,974 | 1/1984 | Muller et al. | 400/208 X |
| 4,448,556 | 5/1984 | Trezise et al. | 400/196 X |

FOREIGN PATENT DOCUMENTS

| | | | |
|---|---|---|---|
| 67278 | 6/1981 | Japan | 400/208 |
| 2114954 | 9/1983 | United Kingdom | 400/208 |

*Primary Examiner*—Clifford D. Crowder

*Attorney, Agent, or Firm*—Cushman, Darby & Cushman

[57] ABSTRACT

In a transfer material feeding device to be set in a transfer apparatus, a sheetlike transfer material is impregnated with a color agent. The two end portions of the transfer material are wound individually on a pair of roll shafts. The transfer material feeding device further comprises a case which integrally encloses the roll shafts and the transfer material and has an opening formed on one side through which that part of the transfer material located between the roll shafts is exposed. Thus, the transfer material feeding device has the form of a cassette.

6 Claims, 21 Drawing Figures

TRANSFER MATERIAL FEEDING DEVICE

BACKGROUND OF THE INVENTION

The present invention relates to a transfer material feeding device used in a transfer apparatus which is adapted to supply a color agent to a sheet, in accordance with an image to be formed on the sheet.

Among conventional transfer apparatuses of this type, there are thermal transfer printing machines which print an image on a sheet by heating part of a ribbon (transfer material) coated with, e.g., ink (color agent). Generally small-sized, low-priced, noise-free, and capable of printing on ordinary paper, these printing machines have recently been used for computers, recorders for the output of word processors, and copying apparatuses.

In the prior art transfer apparatuses of this type, an unused ribbon on one roll shaft is wound around another roll shaft after the ribbon has been used for printing.

Thus, a conventional transfer material feeding device is provided only with a roll shaft and a ribbon (transfer material) wound thereon. In setting a replaceable ribbon in the transfer apparatus, the roll shaft wound with the ribbon is mounted on a ribbon setting shaft in the apparatus housing. Then, an operator must draw out one end portion of the ribbon from the roll shaft, and wind it around a separate empty roll shaft by hand. Thus, the prior art transfer material feeding device is subject to the following drawbacks.

1. The replacement of the ribbon is troublesome and time-consuming:
2. The operator must directly touch the ribbon coated with the color agent, thus soiling his hands.
3. The operation of winding one end portion of the ribbon around the empty roll shaft by hand requires extra space.
4. The ribbon may be crumpled or flawed while it is wound around the empty roll shaft, possibly causing defective image formation.

SUMMARY OF THE INVENTION

An object of the present invention is to provide a transfer material feeding device enabling an operator to securely replace a transfer material with ease without directly touching the same.

Another object of the invention is to provide a transfer material feeding device in the form of a cassette.

According to an aspect of the invention, there is provided a transfer material feeding device capable of being set in a transfer apparatus which transfers a color agent to a sheet in accordance with a latent image to form an image on the sheet, comprising:

- a transfer material in the form of a sheet and having two end portions, said transfer material including the color agent;
- a pair of roll shafts individually engaging the two end portions of the transfer material and wound with the transfer material, whereby the transfer material is fed in one direction; and
- a case integrally enclosing the pair of roll shafts and the transfer material and opening on one side thereof so that part of the transfer material located between the two roll shafts is exposed.

DETAILED DESCRIPTION OF THE PREFERRED EMBODIMENTS

Preferred embodiments of the present invention will now be described in detail with reference to the accompanying drawings of FIGS. 1 to 21. Referring first to FIGS. 1 to 19, one embodiment of the invention will be described in detail.

Figure 1:
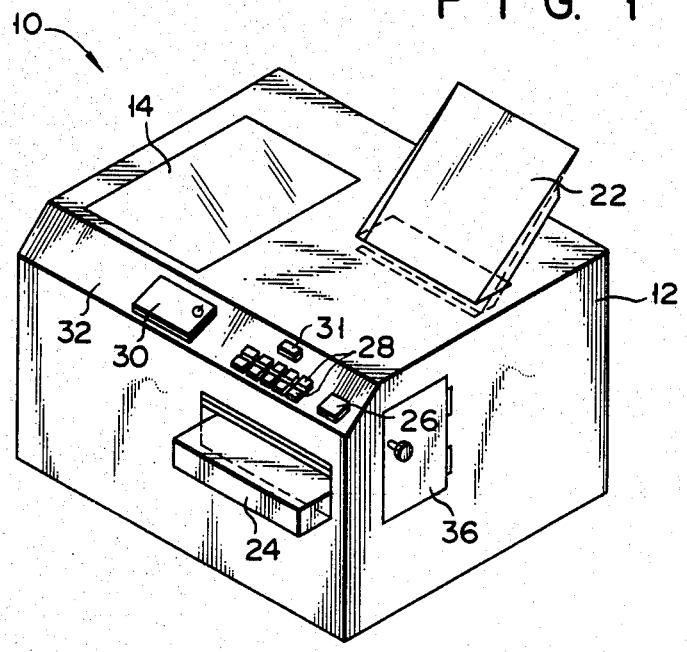
FIG. 1 is a perspective view of a transfer apparatus according to one embodiment of the present invention.
Figure 2:
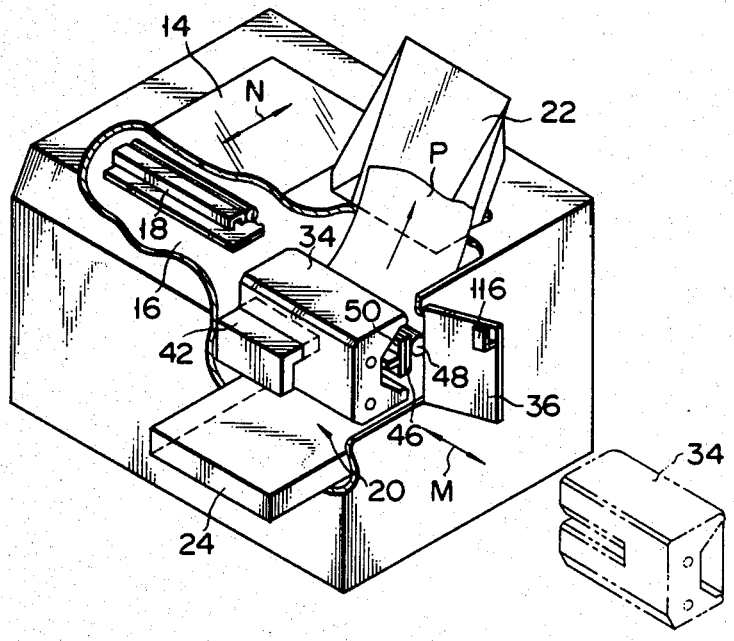
FIG. 2 is a broken away, perspective view schematically showing the transfer apparatus of FIG. 1.

In a copying apparatus (transfer apparatus) 10 having the thermal transfer function according to the first embodiment of the invention, as shown in FIGS. 1 and 2, a housing 12 has an original table 14 at the top of which is placed an original paper to be copied. The original table 14 is formed of a transparent material such as glass. Under the original table 14 lies a scanning unit 16 for scanning the original paper on the original table 14. The scanning unit 16 is provided with an optical exposure system 18 which can move in the direction of arrow N to expose the original. The scanning unit 16 also has a function to convert optical information obtained through the exposure system 18 into an electric signal. Disposed in the central portion of the housing 12 is an image forming unit 20 (mentioned later) for forming an image on a sheet in accordance with the electric signal from the scanning unit 16.

The housing 12 is fitted with a tray 22 at the top for discharging the sheet on which the image has been formed by the image forming unit 20. A sheet cassette 24 for supplying the image forming unit 20 with sheets on which images are to be formed is removably attached to the front of the housing 12. Provided at the upper front portion of the housing 12 is an operator control panel 32 on which is arranged a start button 26, a keyboard including numeral keys 28 bearing numerals 0 to 9, a display 30 for indicating operator guidance, such as "clogging," and a button 31 for ejecting the ribbon cassette.

A door 36 is attached to the flank of the housing 12 which can be opened and closed when setting a ribbon cassette 34 (mentioned later) as a transfer member in the housing 12. The door 36 is provided with a lock mechanism 40 (see FIGS. 16 and 17) which can be locked by operating the numeral keys 28, as mentioned later.

The image forming unit 20 is provided with a holder 42 which regulates the position of the ribbon cassette 34 and holds it in place when the ribbon cassette 34 is set in the housing 12, and a thermal head 46 for heating that portion of the ribbon 44 which is exposed from the ribbon cassette 34 for ink transfer. The thermal head 46 is partially heated in accordance with the electric signal from the exposure system 18, and melts a color agent applied to the ribbon 44 to transfer it to the sheet. A platen 48 for pressing the ribbon 44 and the sheet P against the thermal head 46 faces the thermal head 46 with the ribbon 44 between them. A radiating board 50 for radiating heat generated from the thermal head 46 is disposed at the back (on the sheet cassette side) of the thermal head 46.

Figure 3:
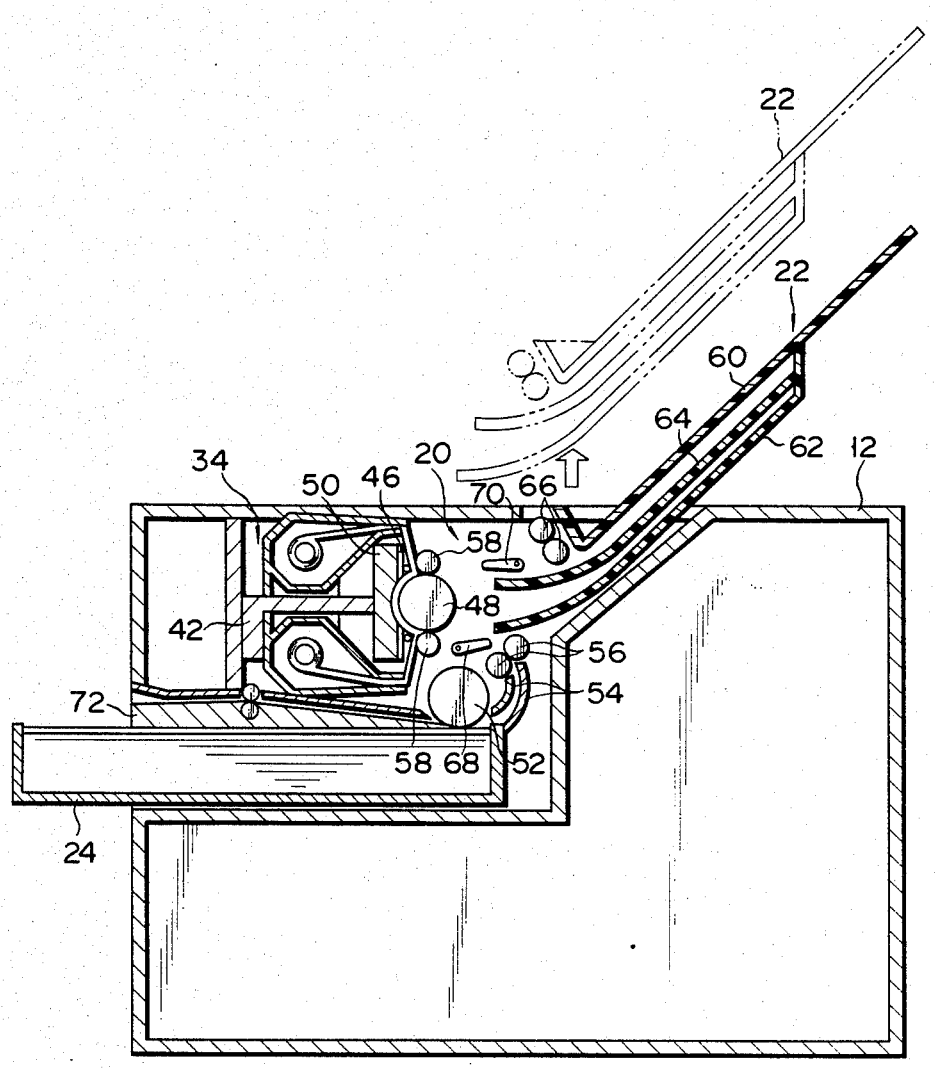
FIG. 3 is a vertical sectional view schematically showing the transfer apparatus of FIG. 1.

In FIG. 3, the image forming unit 20 is shown in detail. A takeout roller 52 is disposed in front of the sheet cassette 24, whereby sheets P are taken out from the cassette 24. Arranged in close vicinity to the takeout roller 52 are a pair of guide plates 54 for guiding each sheet P taken out by the takeout roller 52, and a pair of aligning rollers 56 for aligning the front edge of the guided sheet P. In order to wind the sheet P fed from the aligning rollers 56 around the platen 48, backup rollers 58 are arranged on both the top and bottom sides of the platen 48 so as to press the sheet P against the platen 48.

The tray 22 adjoining the image forming unit 22 is integrally formed of a bearing plate 60 to receive the sheets having undergone image forming, and first and second guide plates 62 and 64 for guiding the sheets under image forming in a manner such that the sheets are temporarily held on the guide plates 62 and 64. A pair of exit rollers 66 for discharging the sheets from the image forming unit 20 onto the bearing plate 60 are arranged at the inner end portion of the bearing plate 60. The tray 22 and the exit rollers 66 are formed as one unit, and are removably attached to the housing 12.

A first distribution guide 68 for changing the course of the sheets during the image forming operation is swingably set between the aligning rollers 56 and the platen 48. The first distribution guide 68 selectively guides those sheets being moved from the aligning rollers 56 toward the platen 48 and those sheets being moved from the platen 48 onto the first guide plate 62. Likewise, a second distribution guide 70 is swingably set between the exit rollers 66 and the platen 48, whereby those sheets being moved onto the bearing plate 60 and those sheets being moved onto the second guide plate 64 are guided selectively. In FIG. 3, numeral 72 designates a sheet-bypass guide which is used when an operator manually feeds sheets one by one into the apparatus.

Figure 4:
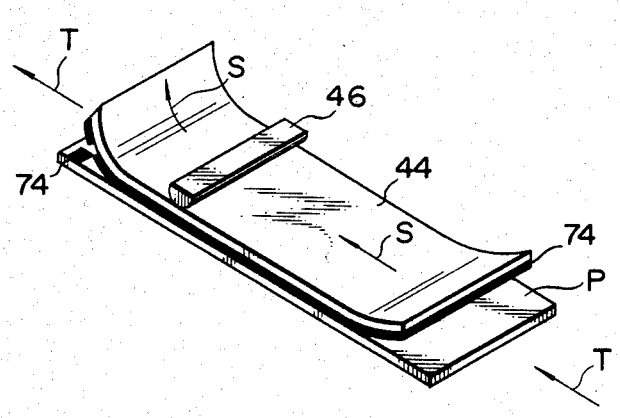
FIG. 4 is a perspective view for illustrating the transferring operation of the transfer apparatus of FIG. 1.

In the thermal transfer printing using the thermal head 46, as shown in FIG. 4, ink (color agent) 74 applied to the ribbon 44 is heated and melted by the thermal head 46, and is transferred to a sheet P. During the thermal transfer, the ribbon 44 and the sheet P move simultaneously in the directions of arrows S and T, respectively.

Figure 5:
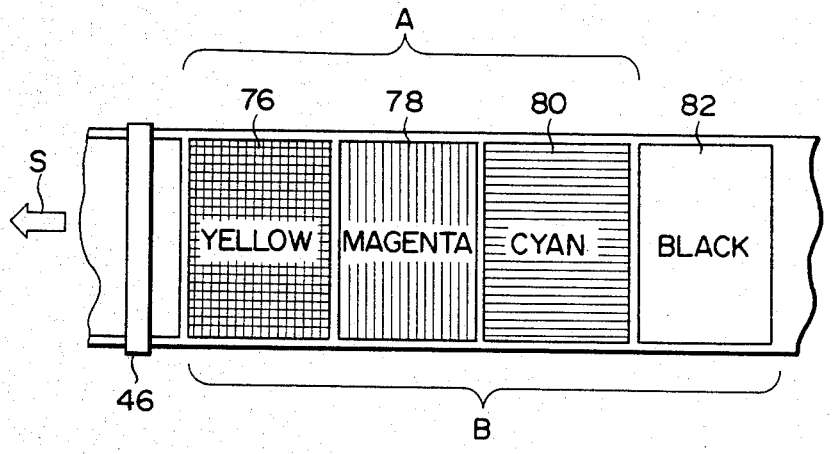
FIG. 5 is a plan view showing the way ink is applied to a ribbon used in the transfer apparatus of FIG. 1.

As shown in FIG. 5, the ribbon 44 has a continuous range A covering, for example, a yellow-ink region 76, a magenta-ink region 78, and a cyan-ink region 80, or a range B covering all these regions 76, 78 and 80 plus a black-ink region 82. In the transfer, one of these ink colors is first transferred to the sheet P. The sheet P is returned to its original position to be subjected to ink transfer for another color. Thus, by repeating this transfer process, some ink colors are superposed to provide a color print. In general, a black color can be obtained by superposing the three colors in the range A. A deeper black color may be obtained by using a ribbon having the range B which covers the four color-ink regions including the black-ink region 82.

With reference to FIGS. 6 to 9, the operation of the image forming unit 20 will be described.

Figure 6:
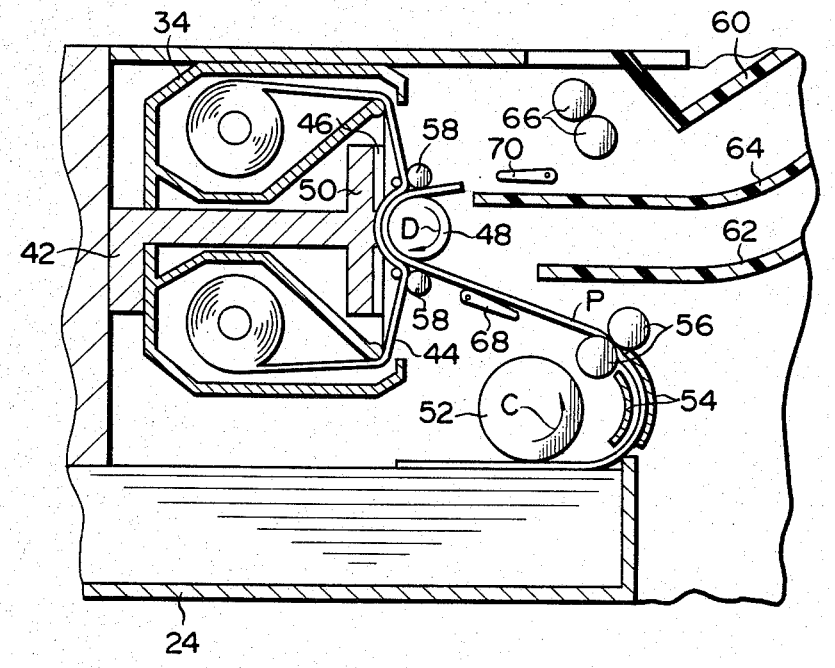
FIGS. 6 to 9 are sectional views for illustrating the operation of the transfer apparatus of FIG. 1.

When the takeout roller 52 rotates in the direction of arrow C, as shown in FIG. 6, a sheet P is taken out from the sheet cassette 24. Then, the sheet P is guided to the aligning rollers 56 by the guide plate 54, and the front edge of the sheet P is aligned by the aligning rollers 56. The sheet P is further conveyed to reach the platen 48. Since the platen 48 is rotated in the direction of arrow D, the sheet P moves along the platen 48 to face the thermal head 46 across the ribbon 44. As mentioned before, the thermal head 46 heats part of the ribbon 44 in accordance with the signal from the exposure system 18, thereby printing the first-color ink of the ribbon 44 on the sheet P.

Figure 7:
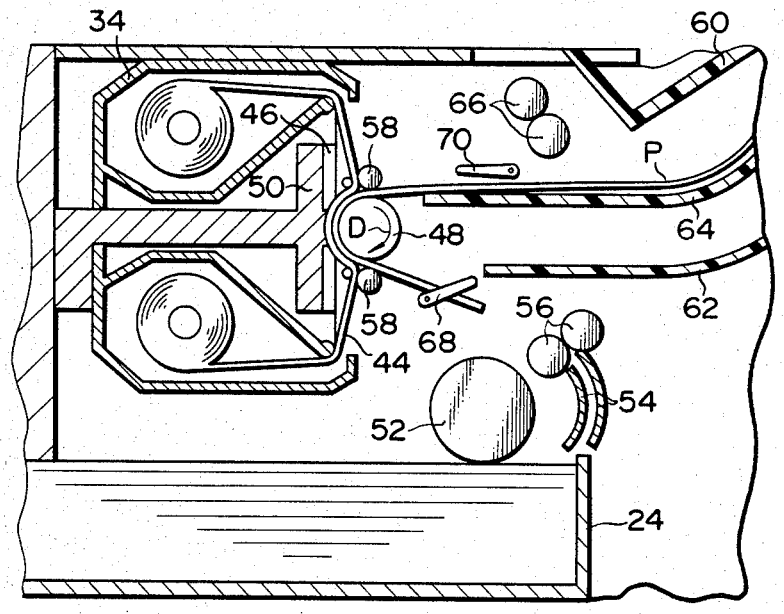

As shown in FIG. 7, the second distribution guide 70 is located substantially parallel to the second guide plate 64, and guides the sheet P having undergone the first printing cycle for the first color so that it is temporarily located on the second guide plate 64. The first distribution guide 68 rocks counterclockwise to take a diagonally upward position when the sheet P is about to finish passing by the guide 68.

Figure 8:
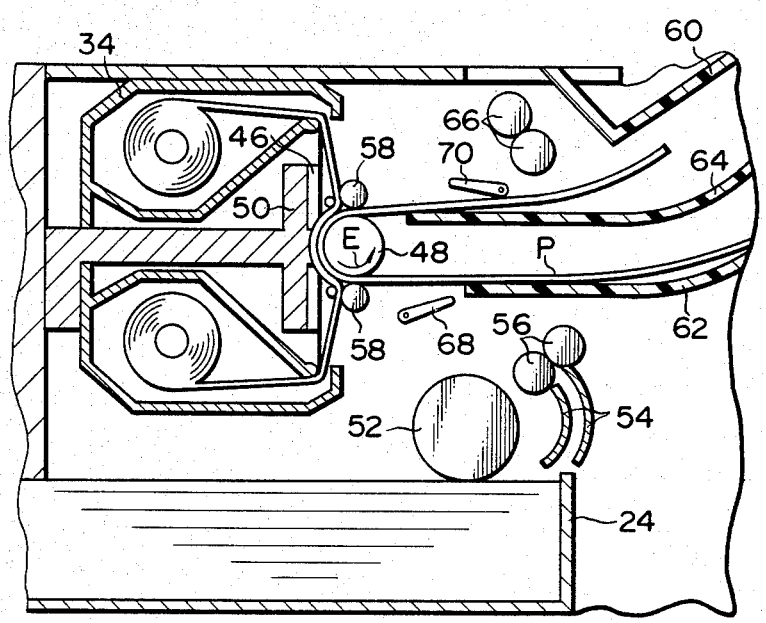

The sheet P having undergone the first printing cycle for the first color is moved from the upper surface of the second guide plate 64 to the upper surface of the first guide plate 62, as shown in FIG. 8. Namely, the sheet P is temporarily returned to the first guide plate 62 for the second printing cycle for the second color. The platen 48 is rotated counterclockwise or in the direction of arrow E, so that the sheet P is moved along the first guide plate 62. Since the first distribution guide 68 is held in the diagonally upward position, the sheet P smoothly moves along the upper surface of the first guide plate 62.

Figure 9:
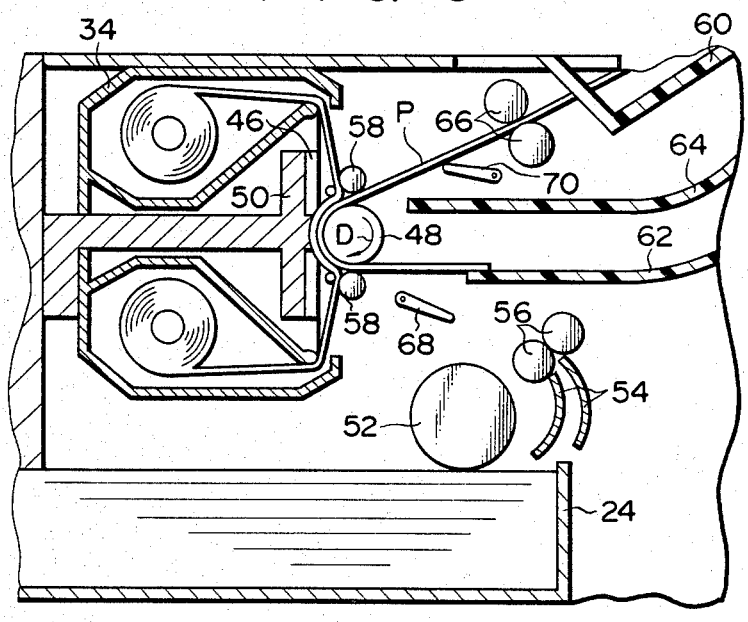

When the sheet P finishes being transferred to the upper surface of the first guide plate 62, the platen 48 rotates again in the direction of arrow D, as shown in FIG. 9, for the second printing cycle for the second color. After the printing process is thus repeated for the second, third and fourth colors, the second distribution guide 70 is held in its diagonally upward position so that the sheet P can be discharged onto the bearing plate 60. After the printing (image formation) is completed, the sheet P is discharged onto the bearing plate 60 of the tray 22.

Figure 10:
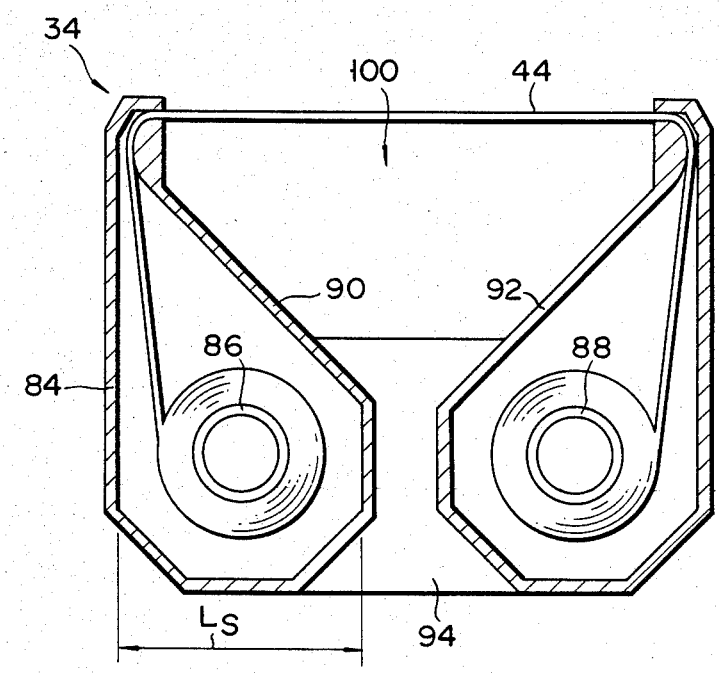
FIG. 10 is a sectional view of a ribbon cassette used in the transfer apparatus of FIG. 1.

With reference to FIGS. 10 to 14, the ribbon cassette 34 will be described in detail. In the ribbon cassette 34, as shown in FIG. 10, two substantially parallel roll shafts 86 and 88 wound individually with the two end portions of the ribbon 44 are arranged inside a case 84. The ribbon 44 is enclosed by the case 84 so as to be partially exposed.

Figure 11:
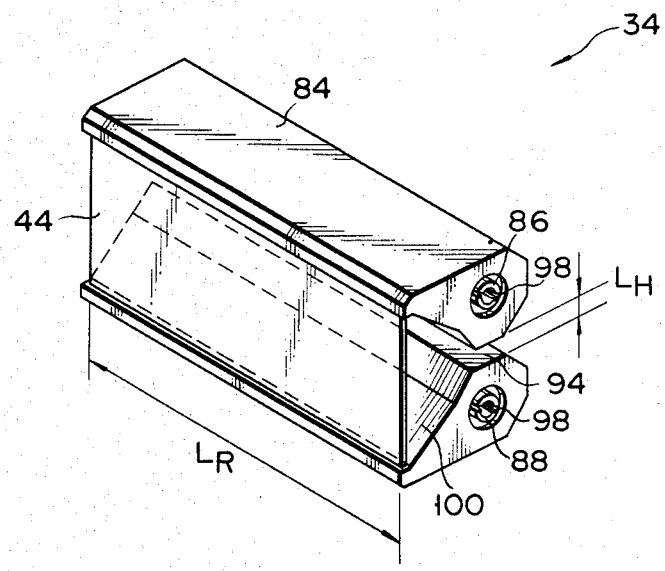
FIG. 11 is a perspective view of the ribbon cassette shown in FIG. 10.
Figure 12:
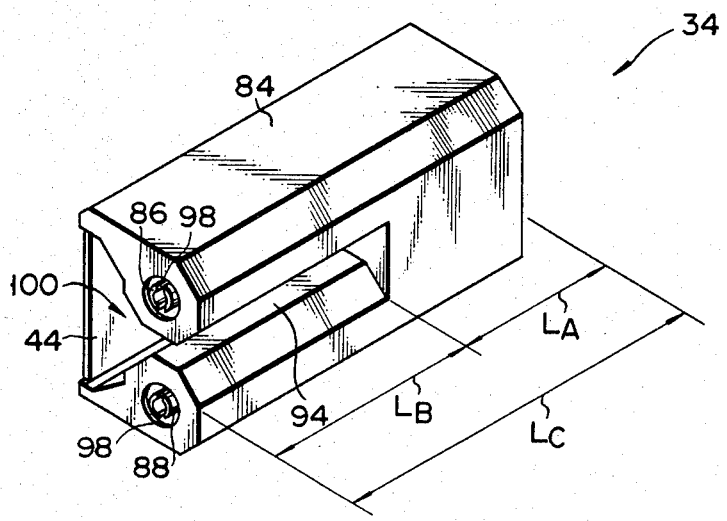
FIG. 12 is another perspective view of the ribbon cassette of FIG. 11 taken from another direction.

As shown in FIGS. 10 to 12, a slit 94 to receive the holder 42 is defined between case portions 90 and 92 which contain the roll shafts 86 and 88, respectively, and the ribbon 44 wound on the roll shafts 86 and 88. As shown in FIG. 12, the slit 94 extends along the extending direction of the roll shafts 86 and 88 and terminates in the middle of the case 84. A pair of notches 98 for the connection with a drive mechanism 96 (mentioned later) are formed in the slit-side end portion of each of the roll shafts 86 and 88.

Figure 13:
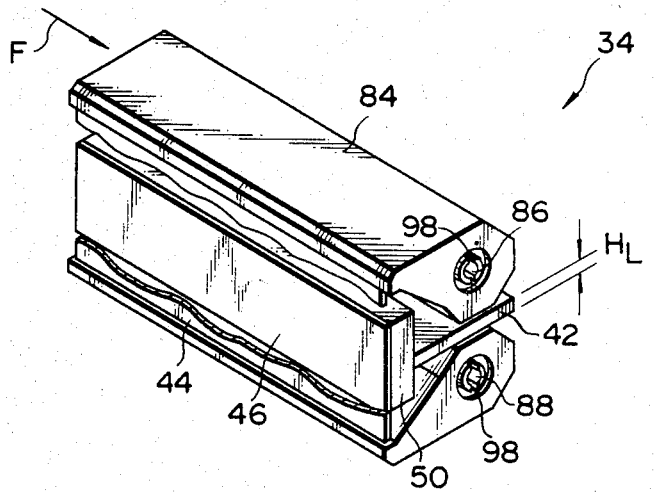
FIGS. 13 and 14 are perspective views for illustrating how the ribbon cassette of FIG. 11 is set in place.
Figure 14:
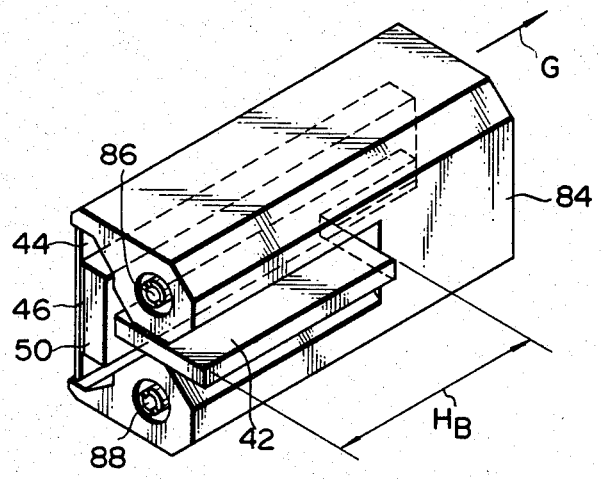

In the ribbon cassette 34, moreover, a space 100 capable of receiving the thermal head 46 is defined between the exposed portion of the ribbon 44 and the case portions 90 and 92. As shown in FIGS. 13 and 14, the space 100 extends along the extending direction of the roll shafts 86 and 88. With this arrangement, as shown in FIGS. 13 and 14, the ribbon cassette 34 is pushed in the direction of arrow F against the holder 42 and the thermal head 46 when it is inserted into the housing 12. When the ribbon cassette 34 is removed from the housing 12, it is drawn out in the direction of arrow G.

The dimensions of the ribbon cassette 34 are as follows. In FIGS. 10 to 14, the width of the ribbon 44 is indicated by $L_R$ (FIG. 11); the maximum ribbon roll diameter is indicated by $L_S$ (FIG. 10); the slit width is indicated by $L_B$ (FIG. 12); the slit height is indicated by $L_H$ (FIG. 11); the overall ribbon cassette length is indicated by $L_C$ (FIG. 12); the width of slitless portion of ribbon cassette is indicated by $L_A$ (FIG. 12); the holder thickness is indicated by $H_L$ (FIG. 13); and the holder width is indicated by $H_B$ (FIG. 14). Hereupon, there is given a relation $L_B > \frac{1}{2}L_C$. In this embodiment, $L_C$ and $L_B$ are set to be 250 mm and approximately 160 mm, respectively. Thus, the width $L_B$ of the slit 94 to receive the holder 42 is greater than one-half of the overall length $L_C$ of the ribbon cassette 34, so that the holder 42 can securely hold the ribbon cassette 34 over a long range when the ribbon cassette 34 is set in the housing 12.

Since the transverse supporting strength of the thermal head 46 depends on the width $H_B$ (approximately 160 mm in this embodiment) of the holder 42, the slit 94 is formed in a manner such that $L_B$ (approximately 160 mm) is greater than $L_A$ (approximately 90 mm).

The slit height $L_H$ is a little greater than the holder thickness $H_L$ (approximately 10 mm in this embodiment), while the slit width $L_B$ is substantially equal to the holder width $H_B$ (approximately 160 mm). Thus, in loading the housing 12 with the ribbon cassette 34, no play or backlash will be produced between the holder 42 and the case 84.

Figure 15:
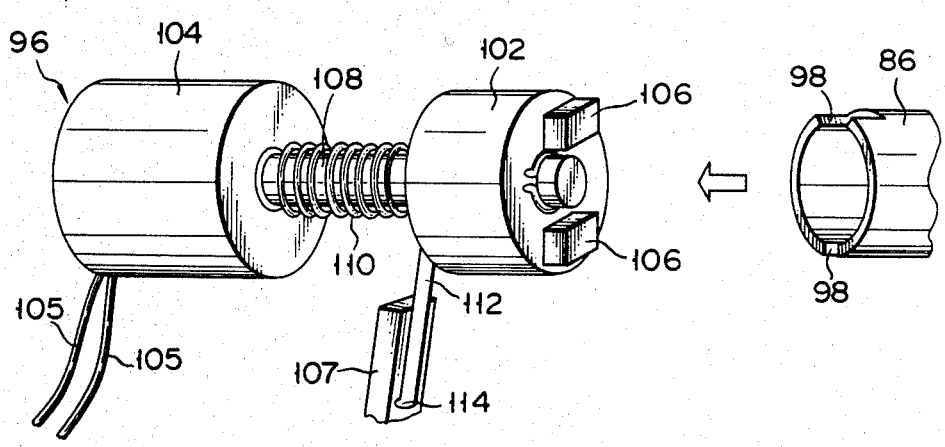
FIG. 15 is a perspective view schematically showing a roll shaft driving unit of the transfer apparatus of FIG. 1.

In FIG. 15 there is shown the drive mechanism 96 for feeding or rewinding the ribbon 44 rolled in the ribbon cassette 34. The drive mechanism 96 is provided with a coupling 102 to engage the notches 98 of the roll shaft 86 or 88 and a motor 104 for supplying power to the coupling 102. The motor 104 is connected to a switch 107 and a power source (not shown) by means of power cords 105. The coupling 102 has a pair of projections 106 which practically engage the pair of notches 98. The pair of projections 106 are diametrically opposed to each other to correspond with the notches 98. The coupling 102 is connected to a drive shaft 108 of the motor 104 so as to be movable along the drive shaft 108. A spring 110, which is wound around the drive shaft 108 so as to extend along the same, urges the coupling 102 so that the coupling 102 is kept away from the motor 104. A lever 112 is fixed to the coupling 102, whereby the switch 107 for starting the motor 104 is turned on. A claw 114 for depressing the switch 107 is formed at the extreme end of the lever 112. The switch 107 is turned on to start the motor 104 when it is depressed by the claw 114. When the claw 114 is disengaged from the switch 107, the switch 107 is turned off to stop the motor 104.

In the drive mechanism 96 constructed in this manner, if the notches 98 of the roll shaft 86 (88) and the projections 106 are not engaged when the ribbon cassette 34 is set in the housing 12, the projections 106 are pressed against the end portion of the roll shaft 86 (88), so that the coupling 102 is moved toward the motor 104 against the urging force of the spring 110. Then, the lever 114 presses the switch 107 to turn it on, so that the drive shaft 108 of the motor 104 starts to rotate. As the drive shaft 108 rotates, the projections 106 shift their positions to be allowed to engage their corresponding notches 98. When the projections 106 engage the notches 98, the coupling 102 is moved by the urging force of the spring 110, so that the claw 114 of the lever 112 leaves the switch 107 to turn it off. When the switch 107 is off, it is separated from the claw 114 of the lever 112. During the normal drive of the motor 104, therefore, the switch 107 will never run against the claw 114, that is, it will not prevent the rotation of the coupling 102.

Figure 16:
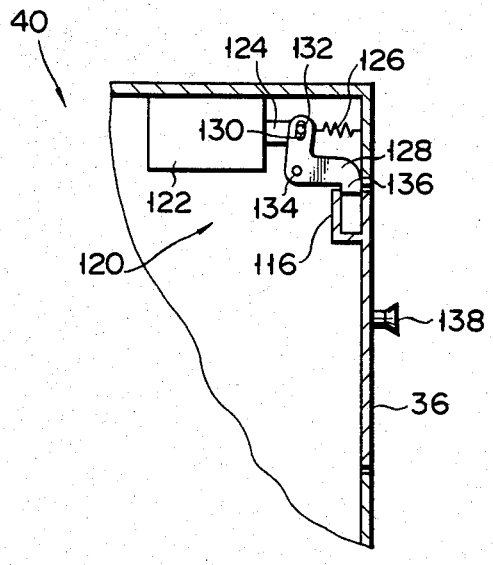
FIGS. 16 and 17 are partial sectional views showing a block mechanism of the transfer apparatus of FIG. 1.
Figure 17:
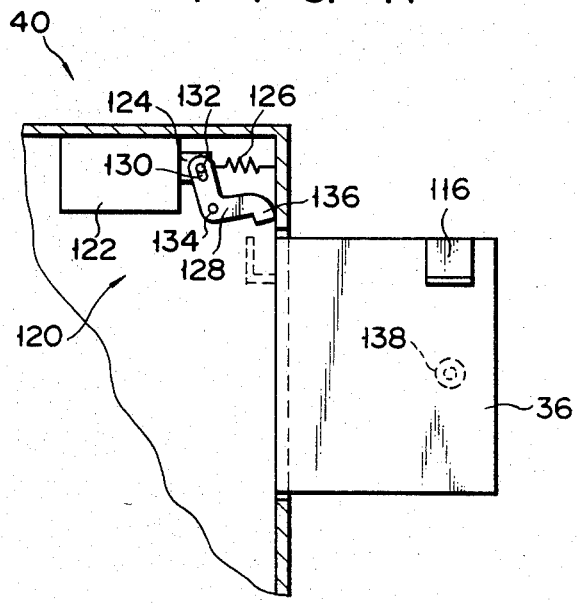

With reference to FIGS. 16 and 17, the lock mechanism 40 will be described. The lock mechanism 40 has an L-shaped hook 116 on the upper portion of the inside face of the door 36, and an engaging unit 120 adapted to engage the hook 116 when supplied with an electric signal from a driving unit 118 mentioned later. The engaging unit 120 is provided with an electromagnet 122 which is excited by the electric signal from the driving unit 118, and a rod 124 which is drawn in when the electromagnet 122 is excited. A spring 126 is coupled to one end portion of the rod 124, whereby the rod 124 is urged in the direction opposite to the direction of its withdrawal. One end portion of a substantially L-shaped arm 128 engages the rod 124. A slot 130 is formed in the one end portion of the arm 128, and the rod 124 and the arm 128 are coupled by means of a pin 132 which can move in the slot 130. The central portion of the arm 128 is rockably supported by a pin 134. A projection 136 protrudes from the other end portion of the arm 128. The projection 136 engages the hook 116 as shown in FIG. 16 when the electromagnet 122 is not excited, and is disengaged from the hook 116 as shown in FIG. 17 when the electromagnet 122 is excited. Numeral 138 designates a door knob attached to the door 36.

Figure 18:
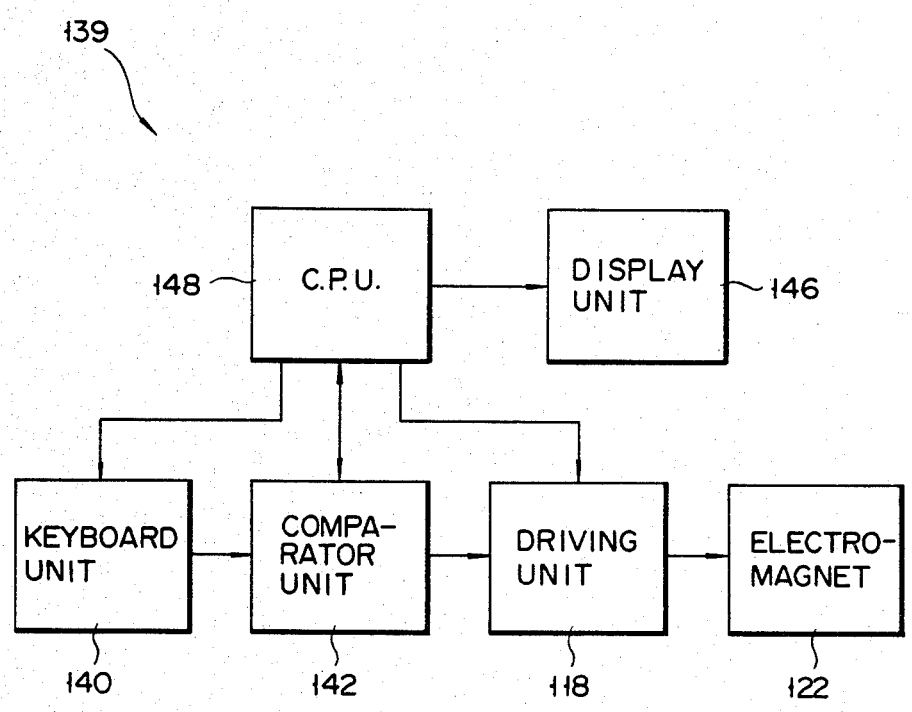
FIG. 18 is a block diagram showing the configuration of the principal part of the transfer apparatus shown in FIG. 1.

FIG. 18 shows a control mechanism 139 for the lock mechanism 40. The control mechanism 139 comprises a keyboard unit 140 including the numeral keys 28 (see FIG. 1), a comparator unit 142 for comparing code signals from the keyboard unit 140, the driving unit 118 for driving the electromagnet 122 in accordance with comparison signals from the comparator unit 142, a display unit 146 for indicating the results of the comparison at the comparator unit 142, and a central processing unit 148 for controlling all those units. When the operator depresses some of the numeral keys 28 to input a specified code signal, the code signal is delivered to the comparator unit 142. The comparator unit 142 fetches a previously stored code signal from the CPU 148, and compares it with the inputted code signal to check for coincidence. If the two code signals are coincident, a coincidence signal is fed to the driving unit 118. On reception of the coincidence signal, the driving unit 118 delivers an electric signal for driving the electromagnet 122.

If the two code signals compared by the comparator unit 142 are not coincident, the comparator unit 142 delivers a noncoincidence signal to the CPU 148. Upon reception of the noncoincidence signal from the comparator unit 142, the CPU 148 delivers a signal, e.g., "NOT COINCIDENT" to the display unit 146. Upon receiving this signal, the display plate 30 displays, "NOT COINCIDENT." The CPU 148 further fetches a signal to the keyboard unit 140 through the depression of the numeral keys 28. In accordance with the fetch signal, the CPU 148 controls the keyboard unit 140 to supply a signal to the comparator unit 142, and delivers a drive signal to the driving unit 118 to control the same. Thus, the driving unit 118 is actuated when it receives the drive signal from the CPU 148 and the drive signal from the comparator unit 142.

Figure 19:
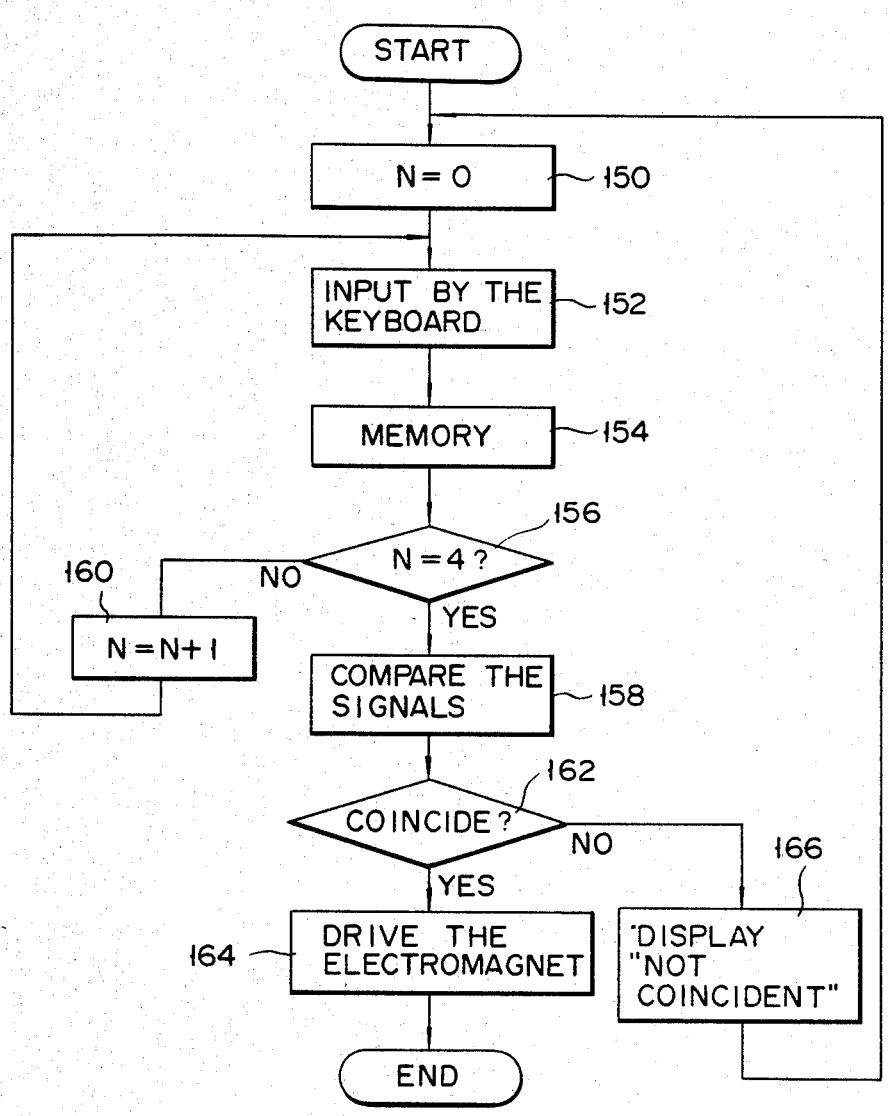
FIG. 19 is a flow chart showing how a ribbon cassette is used in the transfer apparatus of FIG. 1.

With reference to FIG. 19, a ribbon cassette takeout mode will be explained.

The ribbon cassette ejection mode starts when the ribbon cassette ejection button 31 is depressed. In the first step 150 of this mode, a counter for counting the number of inputted numerals is set to 0, and a second step 152 is reached. In the second step 152, one of the numeral keys 28 of the keyboard is depressed to input the first digit out of, for example, the four digits of a four-digit code number. Then, the inputted numeral is stored in a memory in a third step 154, and a fourth step 156 is reached. In the fourth step 156, whether the current number in the counter, i.e., the number of the inputted numerals, is four ($N=4$?) is decided. If the decision is $N=4$, a fifth step 158 is entered. If $N\neq4$ is detected, a sixth step 160 is entered. In the sixth step 160, "1" is added to the counter number N, and the second step 152 is then resumed. In the fifth step 158, the number stored in the memory and the previously recorded secret code number are compared, and a seventh step 162 is then reached. In the seventh step 162, whether the inputted number and the secret code number compared in the fifth step 158 are coincident is decided. If the two numbers prove to be coincident, an eighth step 164 is entered. If noncoincidence is detected, a ninth step 166 is entered. In the ninth step 166, "NOT COINCIDENT" is indicated by the display unit 146, and the first step 150 is then resumed. In the eighth step 164, the electromagnet 122 is actuated in accordance with a signal delivered in the seventh step 162. As the electromagnet 122 is driven, the lock mechanism 40 for the door 36 is released.

Thus, only those persons or operators who are informed of the secret code number can insert or remove the ribbon cassette from the copying apparatus for, e.g., replacement. The door 36 is locked when it is closed after setting the ribbon cassette in place.

According to this first embodiment, outsiders, who are not informed of the secret code number, cannot take out the ribbon cassette from the copying apparatus. Thus, the secrecy of the original can securely be observed.

Figure 20:
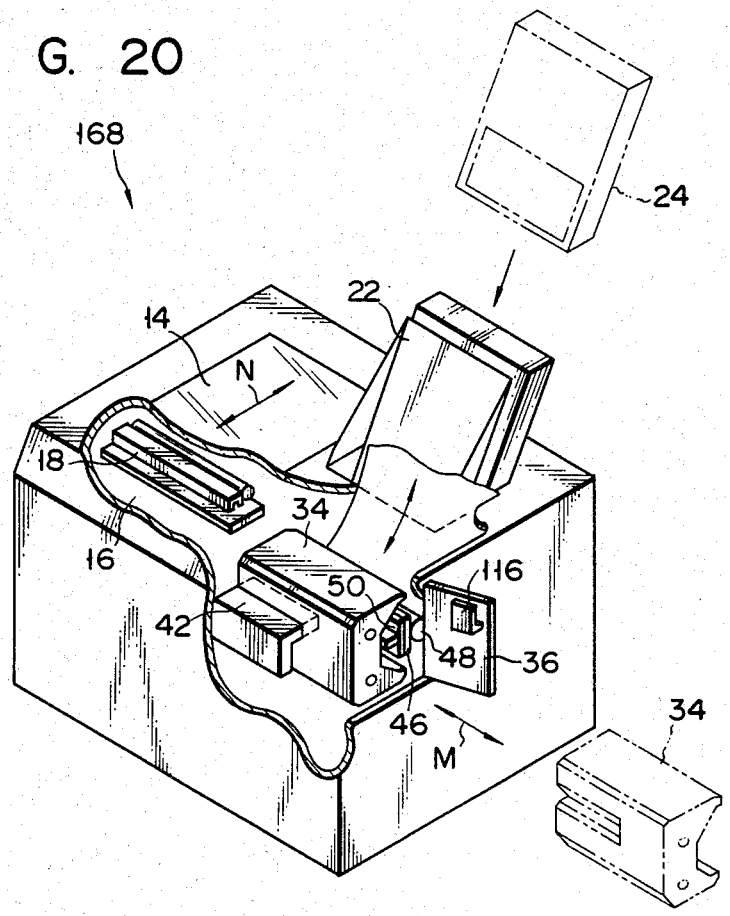
FIG. 20 is a broken away, perspective view of a transfer apparatus according to another embodiment of the invention.
Figure 21:
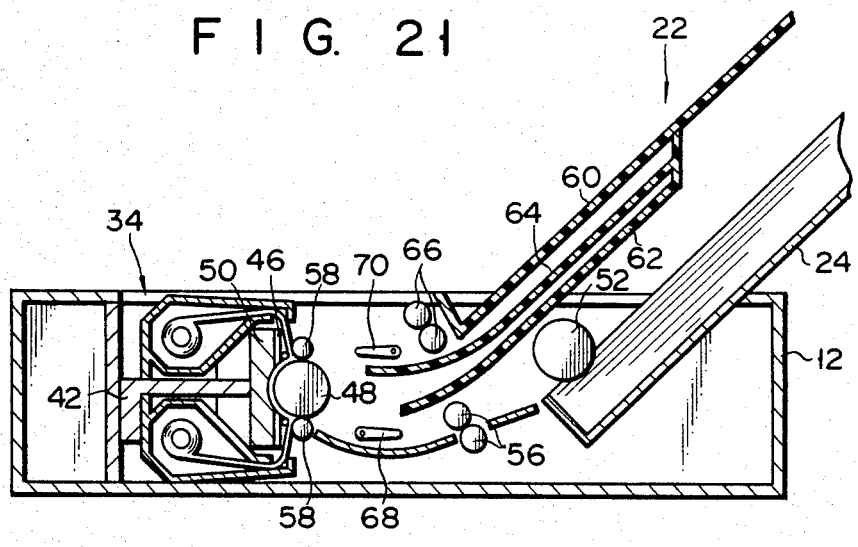
FIG. 21 is a schematic sectional view of the transfer apparatus shown in FIG. 20.

In FIGS. 20 and 21, another embodiment of the invention is shown. In the following description of the second embodiment shown in FIGS. 20 and 21, like reference numerals are used to designate like portions included in the first embodiment, and a detailed description of those portions is omitted.

In a copying apparatus (transfer apparatus) 168 according to the second embodiment, the sheet cassette 24 is attached to the top of the housing 12 so as to be located behind the tray 22. Except for this point of difference, the second embodiment is substantially the same as the first embodiment. Since the sheet cassette 24 is located at the back of the tray 22, the copying apparatus according to the second embodiment can be reduced in overall size, and is free from the obstructive configuration attributed to the location of the sheet cassette.

According to the described embodiments, the ribbon is contained in a case to form a cassette. Therefore, the ribbon can be set in position in the housing of the transfer apparatus by only inserting the ribbon cassette along the holder. Thus, with use of the ribbon cassette according to these embodiments, there may be provided a transfer material feeding device whereby an operator can securely replace a ribbon with ease without directly touching the ribbon.

It is to be understood that the present invention is not limited to the embodiments described above, and that various changes and modifications may be effected therein by one skilled in the art without departing from the scope or spirit of the invention.

In the above embodiments, the present invention is applied to a copying apparatus having a thermal transfer function. However, the transfer material feeding device according to the invention may also be applied to word processors or computers.

In the above-mentioned embodiments, moreover, the slit formed in the case penetrates that portion of the case which is located between the pair of roll shafts so that the slit communicates with the space in which the head is inserted. The slit may, however, be replaced with a groove which extends along the axes of the roll shafts without penetrating any portion of the case. In this case, if the groove is formed so as to cover the full axial length of the roll shafts, the holder can wholly hold the ribbon cassette.

What is claimed is:

1. A transfer material feeding device capable of being set in a transfer apparatus which transfers a color agent to a sheet in accordance with a latent image to form an image on the sheet, comprising:

a transfer material in the form of a sheet and having two end portions, said transfer material including the color agent;

a pair of roll shafts individually engaging two end portions of the transfer material and wound with the transfer material, whereby the transfer material is fed in one direction; and a case integrally enclosing the pair of roll shafts and the transfer material and opening on one side thereof so that part of the transfer material located between the two roll shafts is exposed, said case also having a slit in a surface other than said one side, said slit cooperating with a holder in said transfer apparatus so that the transfer material feeding device is guided through the slit onto the holder to be held thereby when the transfer material feeding device is set in the transfer apparatus.

2. A device according to claim 1, wherein the longitudinal dimension of said slit is greater than one-half the axial dimension of each said roll shaft, so that the length of that part of the transfer material feeding device held by the holder is greater than one-half the overall length of the device.

3. A device according to claim 2, wherein the longitudinal dimension of said slit is approximately two thirds of the axial dimension of each said roll shaft.

4. A device according to claim 3, wherein the transverse dimension of said slit is substantially equal to the thickness of said holder, so that the transfer material feeding device is held on the holder without play when the holder is inserted in the slit.

5. A device according to claim 1, wherein a space communicating with the slit is defined between said pair of roll shafts, and the exposed part of said transfer material, whereby a head in the transfer apparatus for transferring the color agent from the transfer material can enter said space when the transfer material feeding device is set in the transfer apparatus.

6. A device according to claim 1, wherein each said roll shaft has notches at one end portion thereof, for coupling to a driving unit in the transfer apparatus when the transfer material feeding device is set in the transfer apparatus.

* * * * *